US006031969A

United States Patent [19]

Burr et al.

[11] Patent Number: 6,031,969

[45] Date of Patent: Feb. 29, 2000

[54] OMNIDIRECTIONAL PORTABLE APPLIANCE FOR STEAM CLEANING HARD OR FLEXIBLE SURFACES

[75] Inventors: Jean-Marc Burr, Mulhouse; Nicolas Schmitz, Illzach-Modenheim, both of France

[73] Assignee: Superba, France

[21] Appl. No.: 09/050,691

[22] Filed: Mar. 30, 1998

[30] Foreign Application Priority Data

Apr. 28, 1997 [FR] France ..... 97 05226

[51] Int. Cl.[7] ..... A47L 11/34

[52] U.S. Cl. ..... 392/404; 15/320; 68/222; 261/104; 392/395

[58] Field of Search ..... 15/320, 344; 68/222; 122/366; 261/99, 104; 392/390, 394, 395, 405, 406, 404

[56] References Cited

U.S. PATENT DOCUMENTS

| | | |
|---|---|---|
| 2,588,000 | 3/1952 | Hines . |
| 2,849,736 | 9/1958 | Kohle . |
| 5,367,740 | 11/1994 | McCray . |

FOREIGN PATENT DOCUMENTS

| | | |
|---|---|---|
| 0111445 | 6/1984 | European Pat. Off. . |
| 111445A | 6/1984 | European Pat. Off. . |
| 0586762 | 3/1994 | European Pat. Off. . |
| 586762A | 3/1994 | European Pat. Off. . |
| 0672377 | 9/1995 | European Pat. Off. . |
| 672377A | 9/1995 | European Pat. Off. . |
| 2218867 | 9/1974 | France . |
| 7306610 | 9/1974 | France . |
| 2230322 | 12/1974 | France . |
| 7319595 | 12/1974 | France . |
| 2742682 | 6/1997 | France . |
| 303300 | 11/1972 | Germany . |
| 2658878 | 7/1977 | Germany . |
| 9624233 | 1/1996 | WIPO . |

*Primary Examiner*—Terrence R. Till
*Attorney, Agent, or Firm*—Ostrolenk, Faber, Gerb & Soffen, LLP

[57] ABSTRACT

The omnidirectional portable appliance for steam cleaning surfaces both hard and flexible, comprises a case provided with a handle, a water feed orifice, an electricity power cord, a cleaning head, a steam generator included in the case and a venturi device [means for selectively] delivering steam to the cleaning head. The instantaneous steam generator having low thermal inertia operates at atmospheric pressure and comprises a capillary body for storing in divided form all of the supply of water to be evaporated, [in divided form] the capillary body being compressed around [the electrical heater means which comprise] a [metal-clad] resistance element and a heater body constituted by a [having a] material that is a good conductor of heat, is overmolded on the resistance element and [thereon to form a heater body which] is associated with at least one heat transmission element connected to [the] a hottest portion of the heater body and provided with a temperature sensor enabling the control of power fed to the [metal-clad] resistance element to be optimized so as to be safe regardless of the orientation in three dimensions of the steam generator.

25 Claims, 4 Drawing Sheets

OMNIDIRECTIONAL PORTABLE APPLIANCE FOR STEAM CLEANING HARD OR FLEXIBLE SURFACES

The present invention relates to an omnidirectional portable appliance for steam cleaning both hard surfaces and flexible surfaces, the appliance comprising a case provided with a handle, a water feed orifice, an electricity power cord, a cleaning head, a steam generator included inside the case and having storage means for storing a supply of water, and electrical heater means for heating said supply of water to produce steam, and means for selectively delivering steam to the cleaning head.

BACKGROUND OF THE INVENTION

Various portable appliances for steam cleaning smooth surfaces such as plate glass have already been proposed.

Nevertheless, those portable appliances are generally low power appliances, designed to deliver a jet of steam through a dispenser manifold provided with a scraper, such that said appliances are well adapted only to cleaning surfaces that are smooth and hard, such as plate glass or tiles.

Steam-producing boilers are also known which enable steam to be obtained in sufficient quantity for thorough cleaning, but they make steam in an enclosure which also contains the water used to produce the steam, and as a result the boiler must be kept in a well-determined upright position, thereby preventing it from being integrated in a portable cleaner.

Another steam-producing system consists in using a labyrinth. A pump takes water from a tank and propels it to travel along a long path which is heated to a temperature below the critical temperature at which wetting ceases to occur, with the water being transformed progressively along the path into steam. Such a system suffers from the drawback of scaling up quickly and easily, of being relatively large, heavy, and expensive. In existing appliances of that type, it is also impossible to cut down or to increase to any significant extent the quantity of water droplets that are present in the outlet together with the steam.

Steam generators have also been proposed that are of the capillary type in which water is stored in a porous body that is put into contact with an electric heater member which enables steam to be produced instantaneously. That type of steam generator is lightweight, low cost, and relatively insensitive to scale, thereby giving it good lifetime in the context of a portable appliance.

Nevertheless, that type of steam generator has been used up till now only in the context of a low power appliance, given the difficulties associated with controlling heating, particularly when the appliance is to be used in various different positions. Steam cleaning appliances have thus been proposed which operate at a power that does not exceed 300 watts and which use a ceramic resistance element as the electric heater member. Such appliances can be used, for example, for cleaning plate glass, but they do not enable flexible surfaces such as the textile surfaces of seats, sofas, carpets, car seats, drapes, etc. to be cleaned effectively.

OBJECTS AND SUMMARY OF THE INVENTION

The present invention seeks to remedy the above-mentioned drawbacks and to make it possible to provide a portable appliance for steam cleaning which is equally suitable for surfaces that are hard and smooth as for surfaces that are flexible, such as surfaces covered in textile material, and in particular which delivers significant power with a high steam delivery rate while still being lightweight, low cost, quick starting, and capable of being used easily in any position, operating in complete safety, and requiring little maintenance.

These objects are achieved by an omnidirectional portable appliance for steam cleaning both hard surfaces and flexible surfaces, the appliance comprising a case provided with a handle, a water feed orifice, an electricity power cord, a cleaning head, a steam generator included in the case and having storage means for storing a supply of water, and electrical heater means for heating said supply of water to produce steam, and means for selectively delivering steam to the cleaning head, the appliance containing an instantaneous steam generator having low thermal inertia operating at atmospheric pressure and comprising a capillary body for storing all of the supply of water to be evaporated in divided form, the capillary body being compressed around the electrical heater means which comprise a metal-clad resistance having a material that is a good conductor of heat overmolded thereon to form a heater body which is associated with at least one heat transmission element connected to the hottest portion of the heater body and provided with a temperature sensor enabling control of power fed to the metal-clad resistance to be optimized so as to be safe regardless of the orientation in three dimensions of the steam generator.

Advantageously, the metal-clad resistance is U-shaped, having two rectilinear limbs and a bend interconnecting the two rectilinear limbs.

In which case, provision may also be made for a rectilinear heat transmission element to be connected to the heater body in the vicinity of the inside of the bend in the U-shaped metal-clad resistance, which element is provided with a temperature sensor, or for a heat transmission element to be connected to the heater body in the vicinity of the outside of the bend of the U-shaped metal-clad resistance, which element is provided with a temperature sensor, or indeed for two different heat transmission elements to be connected to the heater body respectively in the vicinity of the internal portion and of the external portion of the bend of the U-shaped metal-clad resistance. In which case, the first and second temperature sensors associated with the heat transmission elements connected to the vicinity of the inside and the outside of the bend of the metal-clad resistance have different set points.

According to a particular characteristic of the invention, the heater body includes ribs disposed in the vicinity of the bend in the metal-clad resistance between the rectilinear limbs of said metal-clad resistance.

According to another particular characteristic of the invention, the capillary storage body comprises a first sheet of fibers extending in a plane parallel to the plane defined by the metal-clad resistance and perpendicularly to the two rectilinear limbs of said metal-clad resistance in a zone close to the bend of the metal-clad resistance.

The capillary storage body includes a second sheet of fibers extending perpendicularly to the plane defined by the metal-clad resistance in zones that are close to the two rectilinear limbs and remote from the bend of the metal-clad resistance.

Advantageously, the first sheet of the capillary storage body situated in a zone close to the bend of the resistance has greater compression or volume than the second sheet.

Preferably, each heat transmission element is surrounded by a thermally insulating material in its portion that comes into contact with the porous capillary body.

According to another characteristic of the invention, the steam generator comprises a first removable sealed enclosure into which the water feed orifice opens out from which there starts a primary steam dispensing duct, and within which there is a second enclosure provided with perforations serving to compress the capillary storage body around the heater body.

In a particular embodiment, the heater body includes a plate situated in a midplane defined by the metal-clad resistance and that is V-shaped, flaring outwards near the free ends of the rectilinear limbs of the metal-clad resistance.

The temperature sensor associated with a heat transmission element may be constituted by one of the following elements: thermostat; temperature probe; temperature limiter; and fuse.

In accordance with the invention, it is possible to use a metal-clad resistance rated for power lying in the range 1000 watts to 1500 watts. By using a low cost metal-clad resistance, cost is kept down and the problem of large current surges as can occur when using a ceramic resistance of power in excess of a few hundred watts is avoided. For a portable appliance, it is necessary to ensure that the current does not exceed 10 amps, i.e. about 2300 watts when the electricity supply is at a voltage of 220 V or 240 V.

By means of the measures recommended by the present invention, heating can be controlled reliably in the hottest zone of the heater body such that even in the event of the capillary storage body drying out because of operation in an unfavorable position, safety is ensured because the power supply to the metal-clad resistance can be regulated effectively on the basis of the information provided by the temperature sensor(s) associated with one or both heat transmission elements connected to the hottest portion of the heater body.

The presence of ribs on this hottest portion makes it possible to increase the distance between the overmolding of the metal-clad resistance and the capillary body so as to retain a reliable measurement of the temperature of this hottest portion.

The particular dispositions concerning the capillary body seek to retard drying out of the capillary body in the hottest portion of the heater body.

Insofar as the cleaning appliance of the invention is designed to clean surfaces that are irregular and flexible, such as a carpet or a seat cover, for example, the appliance is capable not only of delivering steam at a high rate, but is also adapted to enable additional mechanical action to be performed by incorporating a brush-shaped member in the cleaning head with the steam produced by the integrated steam generator being delivered through the center thereof.

According to another major characteristic of the invention, the appliance further comprises a tank incorporated in the case and serving to contain an additive in liquid or powder form, said tank being connected by a pipe to a venturi system for injecting the additive into the steam produced by the steam generator to deliver a mixture of steam plus additive to the cleaning head.

The optional presence of an additive, which may merely be water, but which advantageously is a detergent, serves to reinforce the cleaning action on irregular surfaces, while conserving steam that is as pure as possible when cleaning surfaces that are smooth and rigid.

In a particular embodiment, the cleaning appliance of the invention comprises a case having a substantially plane bottom face, a heel-forming rear face, a top face having an opening defining a handle in the form of a loop, and a front end of tapering section to which the cleaning head is connected.

In which case, the additive tank is advantageously placed inside the case behind the loop-shaped handle, the venturi system is disposed in the case in the vicinity of the cleaning head, the pipe connecting the additive tank to the venturi system passes along the loop-shaped handle, and control means are provided in the loop-shaped handle to control selective feed of the additive.

In a particular embodiment, the pipe connecting the additive tank to the venturi system is made of a flexible material such as rubber, and the control means for controlling selective feed of the additive comprises a pinching device for pinching said pipe and a manually-operated trigger for temporarily releasing the pinching device.

The pipe for converging the additive opens out into the center of the venturi system so that the additive is sucked by the steam which is injected into the venturi system concentrically and upstream from a convergent-forming part.

BRIEF DESCRIPTION OF THE DRAWINGS

Other characteristics and advantages of the invention appear from the following description of particular embodiments, given by way of example and with reference to the accompanying drawings, in which.

MORE DETAILED DESCRIPTION

Figure 1:
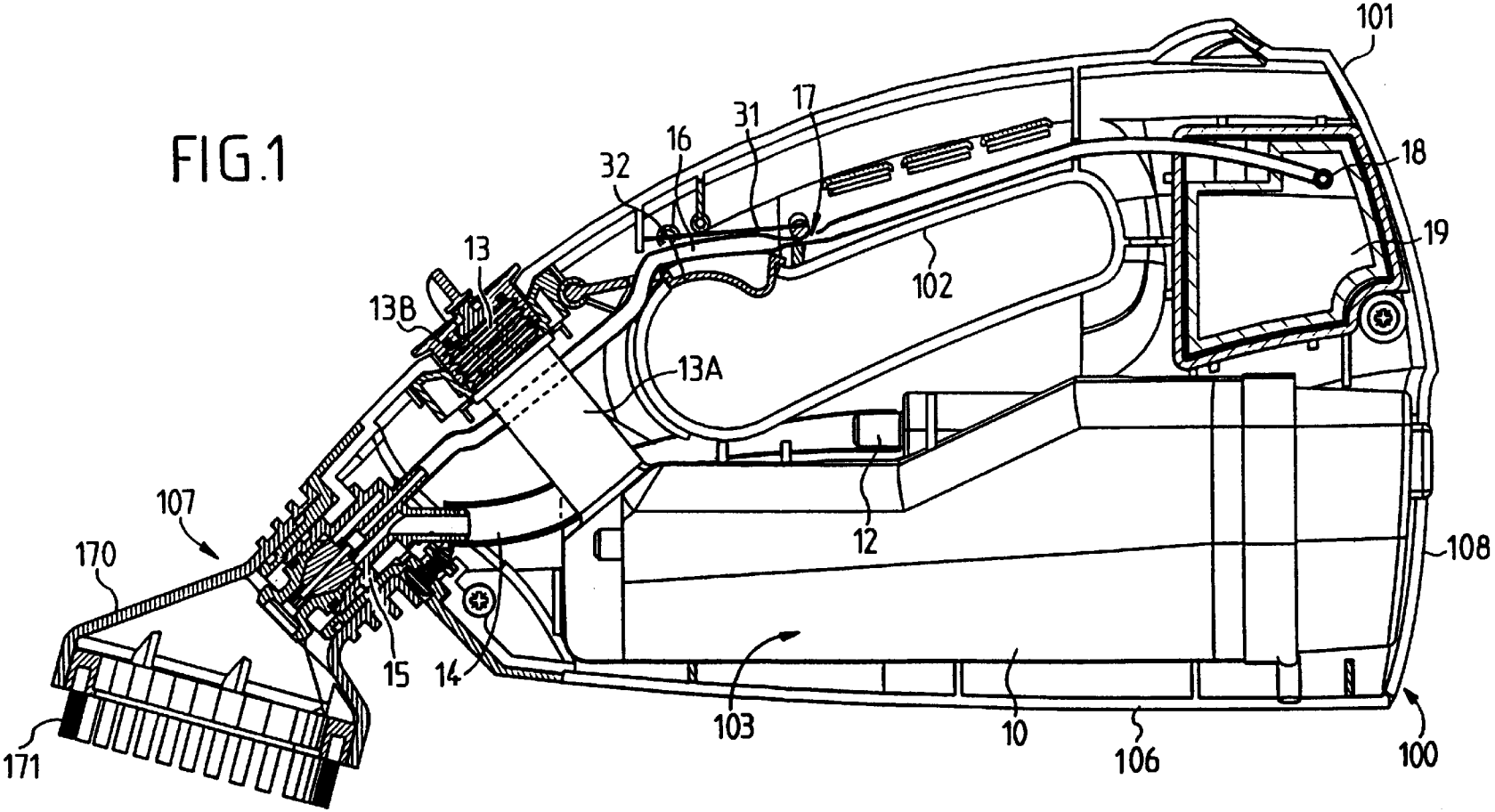
FIG. 1 is an overall view, partially in section and with a portion of the case removed, of an embodiment of a portable steam cleaning appliance of the invention.

An example of an omnidirectional portable appliance 100 of the invention for steam cleaning is shown in FIGS. 1 to 4. Such an appliance 100 comprises a case 101 containing a removable modular assembly 103 which constitutes a steam generator and includes a sealed enclosure 10 from which there runs a primary steam delivery duct 12 which is preferably situated in a raised central portion of the enclosure 10. The enclosure 10 also includes, on its front portion, an opening 11 enabling water to be inserted therein via an outer orifice 13 fitted with a plug 133 and connected to the opening 11 of the enclosure 10 via a duct 13A.

Figure 2:
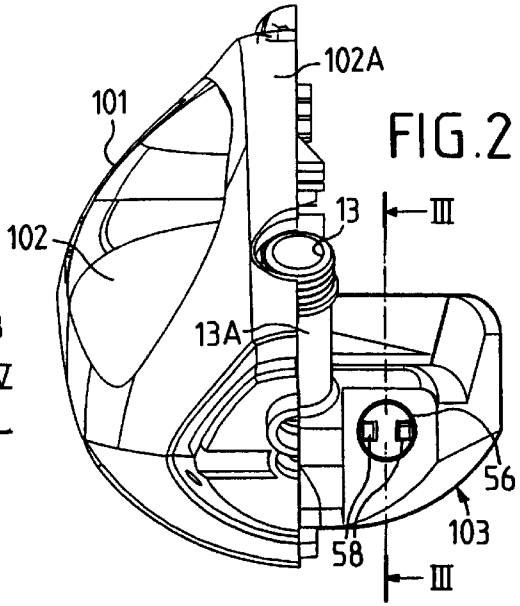
FIG. 2 is an end view of the FIG. 1 appliance, with the cleaning head removed, and also with half of the case removed to show the steam generator.
Figure 3:
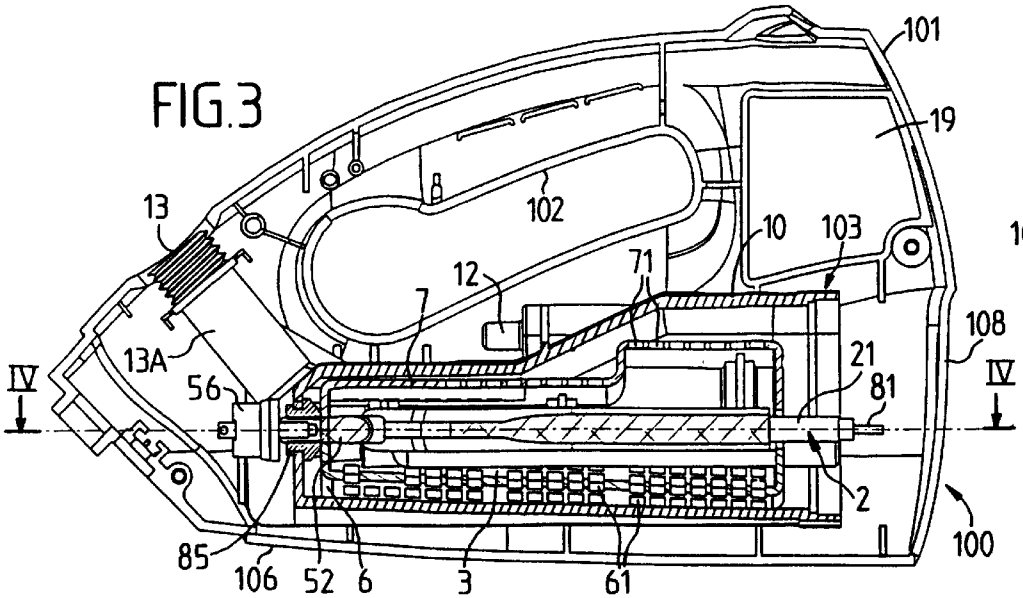
FIG. 3 is a section view on line III—III of FIG. 2.

The case 101, which may be of the particularly compact shape shown in FIGS. 1 to 3, is easy to hold and enables the cleaning head 107 to be pointed easily in any direction. The case 101 thus has: a substantially plane bottom face 106 enabling the appliance to be put down in a stable position when not in use, or while being filled with water via the orifice 13 which is situated on the top of the case 101; a heel-forming rear face 108 which can also be used, where appropriate, for putting the appliance down in a rest position that is vertical with its cleaning head 107 pointing upwards; a top face provided with an opening 102 that defines a built-in handle in the form of a loop 102A; and a front end of tapering section to which the cleaning head 107 is connected.

FIG. 1 also shows a tank 19 for an additive in liquid or powder form and that is incorporated in the case 101, e.g. removably, behind the loop-shaped handle 102A, and that is connected via a pipe 16 to a venturi system 15 for inserting the additive into the steam produced by the steam generator 103 so that the cleaning head 107 receives a mixture of steam and of additive. The venturi system 15 is disposed in the case 101 in the vicinity of the cleaning head 107. The pipe 16 forming the link between the additive tank 19 and the venturi system 15 passes along the handle 102A which includes means 31, 32 for controlling the feeding of additive in selective manner.

Figure 9:
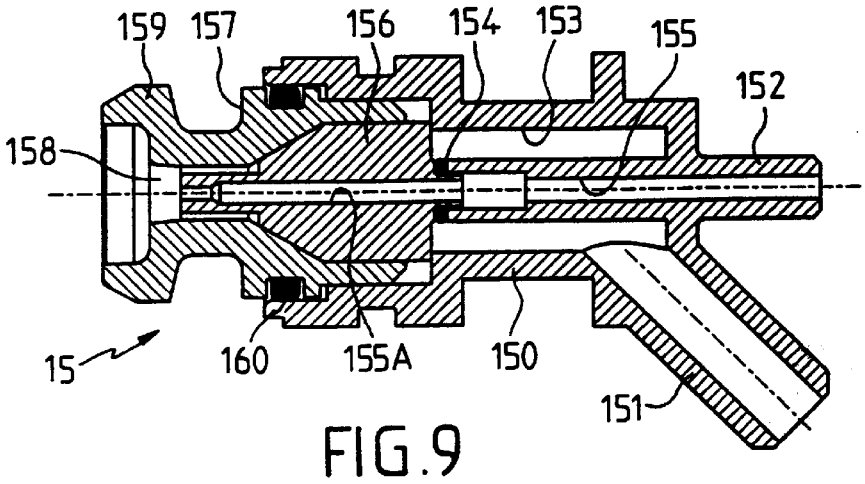
FIG. 9 is a section view of a venturi system capable of being incorporated in a cleaning appliance of the invention, serving to mix an additive in with the steam.

The pipe 16 connected to the tank 19 via a coupling 18 can be made of a flexible material such as rubber. The pipe 16 passes over an abutment 17 where it is pinched by a spring blade 31. A trigger 32 situated in the handle 102A makes it possible by manual action to release the spring blade 31 and thereby release and open the pipe 16. Such a system is simple and effective for feeding an additive liquid to the venturi 15, an embodiment of which is shown on a larger scale in FIG. 9.

The venturi device 15 comprises a body 150 whose rear portion defines an annular chamber 153 into which there opens out a feed 151 connected via a pipe 14 to the outlet 12 of the steam generator 103 to receive pure steam. A feed 152 is also situated at the rear end of the venturi device 15 and serves to connect with the flexible pipe 16 that feeds additive, and to apply said additive to a central duct 155. A central part 156 including a converging portion, e.g. a frustoconical converging portion, is disposed in the body 150 and enables steam coming from the annular chamber 153 to pass into a converging annular space defined between the central part 156 and an outer part 157 of complementary shape. A central channel 155A is formed through the central part 156 in line with the central duct 155 to apply the additive to the center of the venturi system in a zone where the additive is sucked in by the steam inserted concentrically at the upstream end of the converging central part 156. When the additive liquid circuit is open, the steam penetrating into the annular chamber 153 establishes suction at the outlet from the convergent space created by the central part 156 in the vicinity of the arrival of the liquid additive via the channel 155A, thereby making it possible to suck in said additive liquid and to mix it with the steam at the outlet 158 from the head 159 of the venturi device 15. The mixture is then propelled onto the surface to be cleaned through the cleaning head 107 which may include a brush 171 around the dispenser for the mixture into which the venturi device 15 opens out. Parings 154 and 160 provide sealing between the body 150 and the duct 155, and also between the central part 156 and the complementary part 157.

The additive liquid may be pure water, serving both to bombard the surface that is to be cleaned and to entrain dirt that is released by the combined action of the steam and the hot water that is projected by the steam. The additive liquid may alternatively be a detergent, an air freshener, or a disinfectant for killing germs or mites.

It is important to observe that the mechanisms 31, 32 controlling selective feed of the additive enables the user to determine when the appliance is to output steam on its own without any additive, e.g. for cleaning smooth surfaces, and when it is desirable to obtain an output mixture of steam together with a liquid or indeed powder additive so as to increase cleaning capacity. Thus, the appliance of the invention makes it possible to combine at will the action of the heat produced by the steam with the action of an additive such as a chemical detergent or pure water, which action is itself reinforced by the heat and by the fact that the steam jet can bring the additive closer to the particles to be cleaned. The user can also easily add such mechanical action as may be required by means of the brush 171.

The appliance of the invention is thus essentially a consumer appliance for home use that is suitable both for cleaning surfaces that are hard and smooth such as plate glass, mirrors, tiles, cooker tops, ovens, sinks, or laminate-covered furniture, and also surfaces that are flexible and uneven such as textile covers on furniture or car seats, carpets, or drapes.

Compared with prior art portable devices, the effectiveness of the cleaning appliance of the invention is increased because, while remaining light in weight, handy, and low in price, it is capable of instantaneously generating steam at a considerable flow rate (e.g. 30 grams (g) of steam per minute), in complete safety, regardless of the position of the appliance, and without problems of scale diminishing the operating capacity of the appliance.

An important aspect of the invention lies in the particular implementation of the steam generator 103 which, while being light in weight, is capable of delivering power in excess of 1000 watts.

Figure 10:
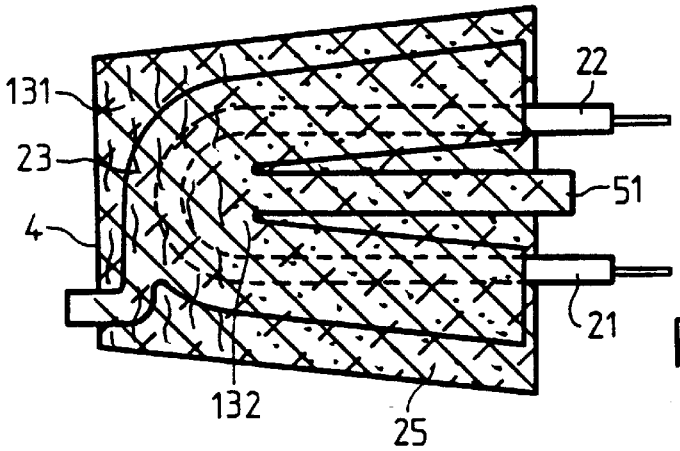
FIG. 10 is a diagrammatic plan view showing one possible way of disposing a capillary body around a heater body in an instantaneous steam generator incorporated in an omnidirectional portable cleaning appliance of the invention.

With reference to FIGS. 2 to 8, it can be seen that inside the sealed enclosure 10 of the steam generator 103 there is to be found a second enclosure constituted by a two-part box 6, 7 each part having respective perforations 61, 71 and serving, when the two parts 6, 7 are closed together and attached to each other by clip elements 62, 72, to compress a capillary storage body 3 placed around a heater body 20. In FIGS. 3, 4, 6, and 7, for clarity in the drawing, the space for receiving the split capillary body that stores the supply of water for evaporating is referenced 3 without the capillary body itself being shown. FIG. 10 shows an embodiment of the capillary body 3 which, by way of example, is constituted by fibers of rock wool that withstand high temperatures. The fibers of the capillary body 3 are compressed by the perforated box 6, 7 around the heater body 20 and serve simultaneously to store the water that is to be evaporated and to provide thermal insulation between the heater body 20 and elements made of plastic, such as the box 6, 7 itself.

The steam generator 103 constitutes a generator for producing steam instantaneously, operating at atmospheric pressure, and comprising a heater body 20 which is constituted by a metal-clad resistance 20 overmolded in metal that is a good conductor of heat, e.g. aluminum, to enhance dissipation of heat from the resistance 2. The metal-clad resistance 2 is U-shaped having two rectilinear limbs 21, 22 and a bend 23 interconnecting the two rectilinear limbs 21, 22.

Figure 4:
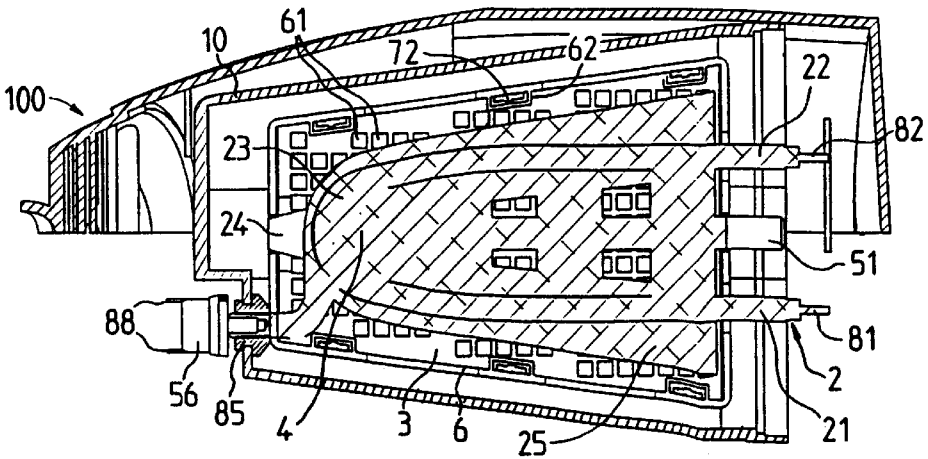
FIG. 4 is a section view on line IV—IV of FIG. 3.
Figure 5:
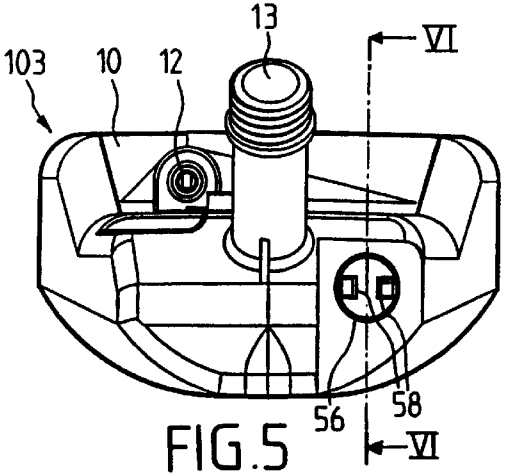
FIG. 5 is an end view of the steam generator on its own as incorporated in the appliance of FIGS. 1 to 4.
Figure 6:
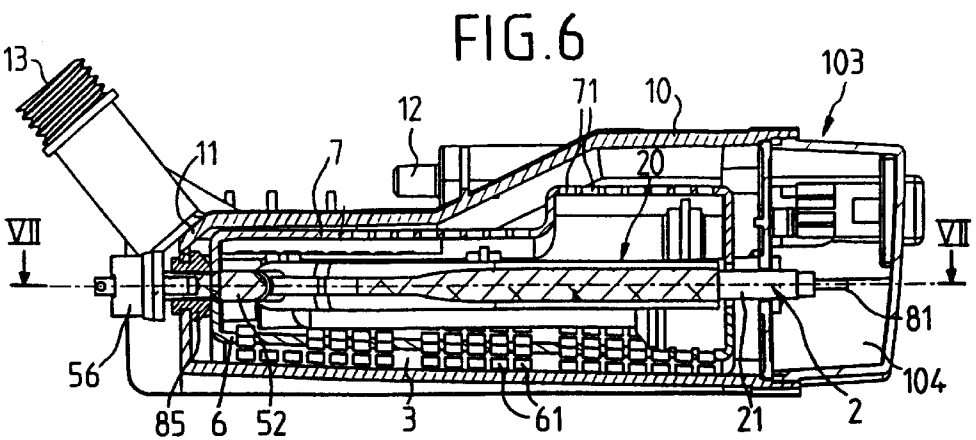
FIG. 6 is a section view on line VI—VI of FIG. 5.
Figure 7:
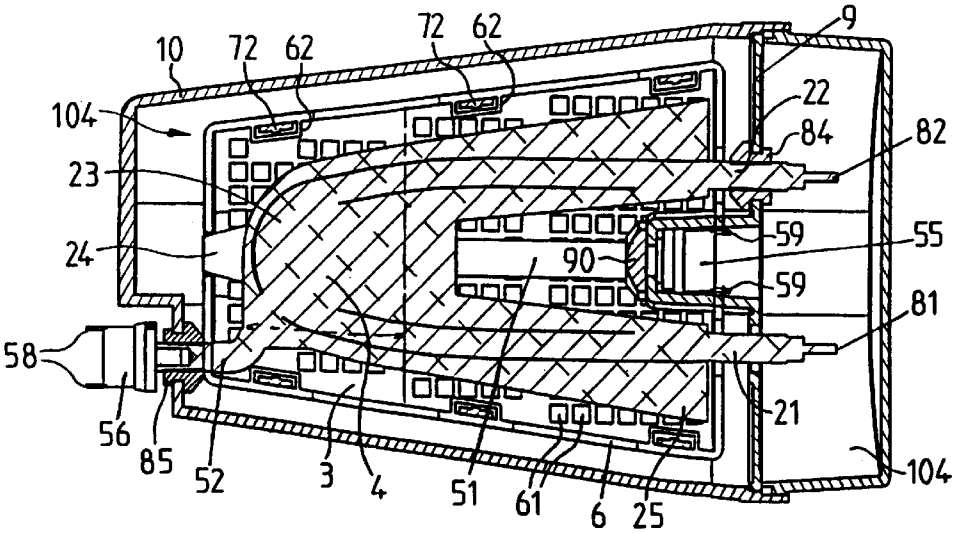
FIG. 7 is a section view on line VII—VII of FIG. 6.
Figure 8:
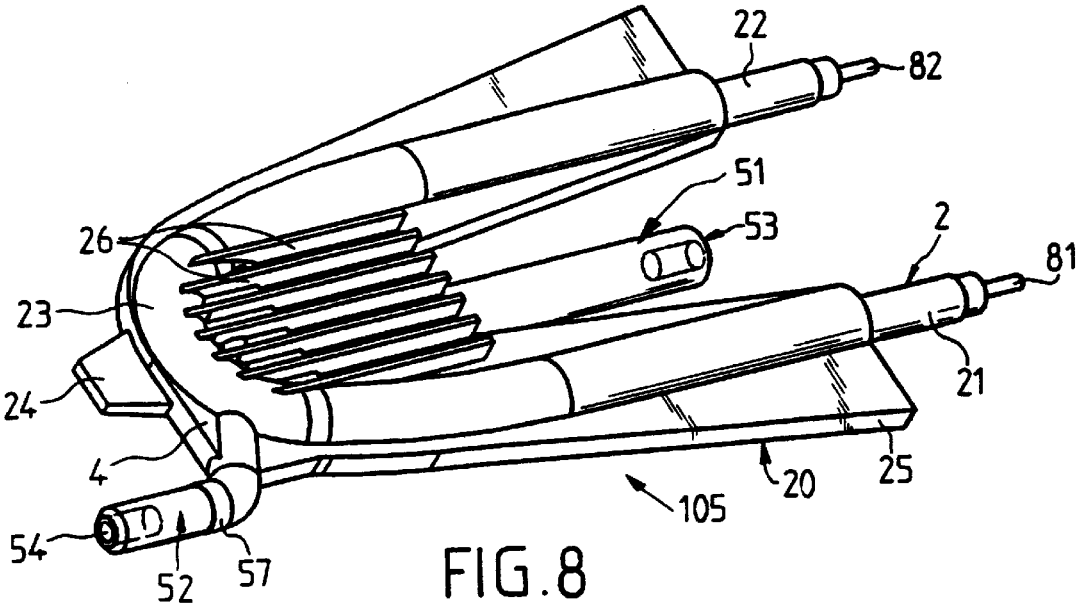
FIG. 8 is a perspective view of a heater body of the invention adapted to the steam generator of FIGS. 5 to 7 and to the cleaning appliance of FIGS. 1 to 4.

As can be seen in particular in FIGS. 4, 7, and 8, the heater body 20 includes a plate 25 situated in a midplane defined by the metal-clad resistance 2 and that is V-shaped flaring outwards at the free ends of the rectilinear limbs 21, 22 of the metal resistance 2. This plate 25 which enhances heat diffusion and which constitutes a unit integral with the semicylindrical metal portions molded over the metal-clad resistance 2, may have an appendix 24, e.g. situated in the vicinity of the curved portion 23 of the resistance 2, for positioning purposes within the box 6, 7.

Advantageously, the heater body 20 has ribs 26 (FIG. 8) disposed in the vicinity of the bend 23 of the resistance 2, between the rectilinear limbs 21, 22 of the resistance 2, in a zone 4 adjacent to the bend 23 which constitutes the zone subjected to the highest power density, and in which temperature rises most quickly in the event of the capillary body 3 drying out.

Given that the cleaning appliance 100 is capable of operating in any direction and is required to operate in any direction, and in particular that it may be put down on the bottom face 106 or on the heel 108 of the case, the zone 4 is greatly exposed to the risk of premature drying out either because of the water flowing downwards under gravity, or because of the water being entrained by the steam formed beneath said zone and rising towards the steam outlet 12, or because of the steam heating the water in the capillary body 3 covering said portion 4.

In accordance with the invention, various means are implemented to reduce overheating of the zone 4 in the vicinity of the bend 23 and to mitigate the effects of said zone 4 being heated to a temperature that is higher than the temperature of the remainder of the capillary body 3.

Thus, as shown in FIG. 10, the capillary storage body 3 may comprise a first sheet 131 of fibers extending in a plane parallel to the plane defined by the metal-clad resistance 2 and perpendicularly to the two rectilinear limbs 21, 22 of said metal-clad resistance 2 in the zone 4 adjacent to the bend 23 of the resistance 2 and corresponding to the presence of the ribs 26 shown in FIG. 8. This contributes to limiting any drying due merely to the water flowing downwards. Similarly, it is advantageous to reinforce the quantity of the capillary body in the first sheet 131 compared with the remainder of the volume of the box 6, 7, e.g. by giving it double thickness so as to increase the extent to which the capillary body is compressed in the zone 4 adjacent to the bend 3, thereby increasing the quantity of water retained when the capillary body 3 is filled with water via the orifice 13.

Advantageously, the capillary body 3 has a second sheet 132 of fibers extending perpendicularly to the plane defined by the resistance 2 in its zones close to the two rectilinear limbs 21, 22 and remote from the bend 23 of the metal-clad resistance.

The shape of the two half-boxes 6, 7 is complementary to the shape of the heater body 20 surrounded by the capillary body 3. It can thus be seen that the box 6, 7 flares outwards away from the bend 23, to accommodate the flare of the V-shaped plate 25.

In accordance with an important characteristic of the invention, a rectilinear heat transmission element 51 is connected to the heater body 20 in the vicinity of the inside of the bend 23 of the resistance 2, and terminates in an end provided with a housing 53 in which a temperature sensor 55 is disposed, as shown in FIG. 7, but omitted from FIGS. 4 and 8. The temperature sensor has two connection tags 59 for connection to elements that regulate the power fed to the resistance 2, which elements may be disposed in a separate compartment 104 adjacent to the sealed enclosure 10 of the steam generator 103.

An angled heat transmission element 52 is connected to the heater body 20 in the vicinity of the outside of the bend 23 of the metal-clad resistance 2 and it terminates, outside the sealed enclosure 10, in an end provided with a housing 54 in which there is received a temperature sensor 56 provided with two connection tabs 58 for connection to the elements that regulate the power supplied to the resistance 2, and placed in the compartment 104 within which the electricity power cord of the cleaning appliance (not shown in the drawings) terminates. The temperature sensor 56 is not shown in FIG. 8.

The temperature transmission elements 51, 52 constitute appendices which start as close as possible to the bend 23 and which can be made by overmolding using the same material as the plate 25, e.g. aluminum.

The temperature sensors 55 and 56, such as thermostats, preferably have different set points so as to provide better regulation of the power fed to the heater resistance 2 whose temperature increases very quickly once the capillary body has dried out in the zone 4 close to the bend 23.

At least the rectilinear heat transmission element 51, and where appropriate also the angled heat transmission element 52, is advantageously thermally insulated by an outer sheath of thermally insulating material such as silicone to avoid it being cooled by non-evaporated water that may possibly be contained near the bottom of the capillary body surrounding the heat transmission element 51.

The rectilinear limbs 21, 22 of the resistance 2 pass through the wall of the enclosure 10 in sealed manner via gaskets such as grommet 84 shown in FIG. 7 and made of a material such as viton, or silicone.

In the same manner, the projections constituting the heat transmission elements 51, 52 pass in sealed manner through the wall of the enclosure 10 via grommets 90, 85 e.g. made of viton® or of silicone (FIG. 7).

The lid of compartment 104 may be ultrasonically welded to the enclosure 10 after assembly has been completed.

The temperature sensors 55, 56 may be constituted by thermostats, temperature probes, temperature limiters, or fuses, for example.

The presence of the temperature sensors 55, 56 and of the heat transmission elements 51, 52 associated with a simple power supply regulator circuit makes it possible to use a U-shaped metal-clad resistance 2 of common type and having a rated power of 1200 watts, for example, without there being any risk of excessive heating, even if a portion of the capillary body 3 dries out in operation.

The assembly comprising the sealed enclosure 10 and the separate compartment 104 which constitutes the steam generator 103 is removable and can easily be replaced. The electrical connections within the compartment 104 are well separated from the enclosure 10 in which water is stored in the capillary body 3 that is compressed by the perforated box 6, 7 around the heater body 20.

The appliance is very simple to use. Tap water is fed in through the inlet 13 which, together with the channel 13A, is integral with the enclosure 10. The water impregnates the capillary body 3 disposed inside the perforated box 6, 7 and any excess water can be poured away via the inlet orifice 13 by turning the appliance upside-down and shaking. After the stopper 13B has been closed and the electricity power cord connected, the appliance is ready to operate. The power fed to the resistance 2 can be regulated automatically in reliable manner without intervention from the operator because of the measures explained above. After having set in the on position the on-off switch which enables the regulated electrical power to be supplied to the resistance 2 to allow the production of steam, the operator need only decide by optionally pressing on the trigger 32 whether or not to mix the optional additive in with the steam, which additive is contained in the tank 19 which may be transparent so that its content can be verified, and which can be removable to facilitate replacement thereof. The operator may at any time stop the production of steam by setting in the off position the on-off switch to interrupt the supply of electrical power to the resistance 2.

We claim:

1. An omnidirectional portable appliance for steam cleaning both hard surfaces and flexible surfaces, the appliance comprising a case provided with a handle, a water feed orifice, an electricity power cord, a cleaning head, a steam generator included in the case and having storage means for storing a supply of water, and electrical heater means for heating said supply of water to produce steam, and means for selectively delivering steam to the cleaning head, the appliance containing an instantaneous steam generator having low thermal inertia operating at atmospheric pressure and comprising a capillary body for storing all of the supply of water to be evaporated, the capillary body being compressed around the electrical heater means which comprise a resistance element and a heater body constituted by a material that is a good conductor of heat, said heater body is overmolded on said resistance element and is associated with at least one heat transmission element connected to a hottest portion of the heater body and provided with a temperature sensor enabling control of power fed to the resistance element to be optimized so as to be safe regardless of the orientation in three dimensions of the steam generator.

2. An appliance according to claim 1, wherein the resistance element is U-shaped, having two rectilinear limbs and a bend interconnecting the two rectilinear limbs.

3. An appliance according to claim 2, wherein the heater body includes a plate situated in a midplane defined by the resistance element and that is V-shaped, flaring outwards near the free ends of the rectilinear limbs of the resistance element.

4. An appliance according to claim 2, having a rectilinear heat transmission element provided with a temperature sensor and connected to the heater body in the vicinity of the inside of the bend in the U-shaped resistance element.

5. An appliance according to claim 4, including a heat transmission element provided with a temperature sensor and connected to the heater body in the vicinity of the outside of the bend of the U-shaped resistance element, and wherein the first and second temperature sensors associated with the heat transmission elements connected to the vicinity of the inside and the outside of the bend of the resistance element have different set points.

6. An appliance according to claim 2, including a heat transmission element provided with a temperature sensor and connected to the heater body in the vicinity of the outside of the bend of the U-shaped resistance element.

7. An appliance according to claim 2, wherein the heater body includes ribs disposed in the vicinity of the bend in the resistance element between the rectilinear limbs of said resistance element.

8. An appliance according to claim 2, wherein the capillary storage body comprises a first sheet of fibers extending in a plane parallel to a lane defined by the resistance element and perpendicularly to the two rectilinear limbs of said resistance element in a zone close to the bend of the resistance element.

9. An appliance according to claim 8, wherein the capillary storage body includes a second sheet of fibers extending perpendicularly to the plane defined by the resistance element in zones that are close to the two rectilinear limbs and remote from the bend of the resistance element, and wherein the first sheet of the capillary storage body situated in a zone close to the bend of the resistance element has greater compression or volume than the second sheet.

10. An appliance according to claim 2, wherein the capillary storage body includes a second sheet of fibers extending perpendicularly to plane defined by the resistance element in zones that are close to the two rectilinear limbs and remote from the bend of the resistance element.

11. An appliance according to claim 1, wherein each heat transmission element is surrounded by a thermally insulating material in its portion that comes into contact with the porous capillary body.

12. An appliance according to claim 1, wherein the resistance element has a power rating lying in the range 1000 watts to 1500 watts.

13. An appliance according to claim 1, wherein the steam generator comprises a first removable sealed enclosure into which the water feed orifice opens out from which there starts a primary steam dispensing duct, and within which there is a second enclosure provided with perforations serving to compress the capillary storage body around the heater body.

14. An appliance according to claim 13, wherein the resistance element is U-shaped, having two rectilinear limbs and a bend interconnecting the two rectilinear limbs, and wherein the steam generator has a water feed orifice which opens out in the vicinity of the bend of the resistance element, and a primary steam dispensing duct situated in a raised central portion of the first enclosure.

15. An appliance according to claim 1, wherein the heater body is constituted by aluminum.

16. An appliance according to claim 1, wherein the temperature sensor associated with a heat transmission element is constituted by one of the following elements: thermostat; temperature probe; temperature limiter; fuse.

17. An appliance according to claim 1, wherein the capillary storage body is constituted by fibers of rock wool.

18. An appliance according to claim 1, wherein said case has a substantially plane bottom face, a heel-forming rear face, a top face having an opening defining said handle in the form of a loop, and a front end of tapering section to which the cleaning head is connected.

19. An appliance according to claim 18, further comprising a tank incorporated in the case and serving to contain an additive in liquid or powder form, said tank being connected by a pipe to a venturi system for injecting the additive into the steam produced by the steam generator to deliver a mixture of steam plus additive to the cleaning head, wherein the additive tank is placed inside the case behind the loop-shaped handle, wherein the venturi system is disposed in the case in the vicinity of the cleaning head, wherein the pipe connecting the additive tank to the venturi system passes along the loop-shaped handle, and wherein control means are provided in the loop-shaped handle to control selective feed of the additive.

20. An appliance according to claim 19, wherein the pipe connecting the additive tank to the venturi system is made of a flexible material, and wherein the control means for controlling selective feed of the additive comprises a pinching device for pinching said pipe and a manually-operated trigger for temporarily releasing the pinching device.

21. An appliance according to claim 1, further comprising a tank incorporated in the case and serving to contain an additive in liquid or powder form, said tank being connected by a pipe to a venturi system for injecting the additive into the steam produced by the steam generator to deliver a mixture of steam plus additive to the cleaning head.

22. An appliance according to claim 21, wherein the additive is in liquid form and comprises one of the products constituted by pure water, a detergent, an air freshener, a perfume, a disinfectant for killing germs, a disinfectant for killing mites.

23. An appliance according to claim 21, wherein the pipe for converging the additive opens out into the center of the venturi system so that the additive is sucked by the steam which is injected into the venturi system concentrically and upstream from a convergent portion.

24. An appliance according to claim 1, wherein the cleaning head includes a brush-shaped member in the center of which the steam produced by the integrated steam generator is delivered.

25. An appliance according to claim 1, constituting an appliance for home use in cleaning hard surfaces comprising plate glass, mirrors, tiles, cooker tops, and also flexible surfaces comprising textile covers of furniture, car seats, carpets.

* * * * *